US011399632B2

(12) United States Patent
Tuttle

(10) Patent No.: US 11,399,632 B2
(45) Date of Patent: Aug. 2, 2022

(54) PEDICURE FOOT STAND

(71) Applicant: OJIP, LLC, Los Angeles, CA (US)

(72) Inventor: Sarah Gibson Tuttle, Los Angeles, CA (US)

(73) Assignee: OJIP, LLC, Los Angeles, CA (US)

( * ) Notice: Subject to any disclaimer, the term of this patent is extended or adjusted under 35 U.S.C. 154(b) by 0 days.

(21) Appl. No.: 17/325,768

(22) Filed: May 20, 2021

(65) Prior Publication Data

US 2022/0087436 A1 Mar. 24, 2022

Related U.S. Application Data

(60) Provisional application No. 63/082,279, filed on Sep. 23, 2020.

(51) Int. Cl.
*A45D 29/20* (2006.01)
*A47C 16/02* (2006.01)

(52) U.S. Cl.
CPC ..... *A47C 16/025* (2013.01); *A45D 29/20* (2013.01)

(58) Field of Classification Search
CPC ..... A45D 29/18; A45D 29/20; A45D 29/22; A45D 29/00; A47C 16/02; A47C 16/025; A47L 23/16; A47L 23/18; A47L 23/28; A47G 25/84; A61B 17/54; B65D 21/0234; B65D 21/0209; B65D 11/188
USPC ..... 132/73, 75; 206/581; 15/265, 266, 267, 15/258, 259; 220/4.21, 4.24
See application file for complete search history.

(56) References Cited

U.S. PATENT DOCUMENTS

| | | | | | |
|---|---|---|---|---|---|
| 461,974 | A | * | 10/1891 | Button | A47C 16/025 297/185 |
| 2,108,241 | A | * | 2/1938 | Wallace | A47C 16/02 248/157 |
| 2,517,232 | A | | 8/1950 | Patulski | |
| D162,870 | S | | 4/1951 | Pearce | |
| 2,628,623 | A | | 2/1953 | Reid | |
| 2,664,585 | A | * | 1/1954 | Gaither | A47L 23/16 15/265 |
| 2,676,597 | A | | 4/1954 | Colbert | |
| 4,017,987 | A | | 4/1977 | Perez, Jr. et al. | |
| 4,207,880 | A | | 6/1980 | Zinkovich | |
| 4,441,758 | A | | 4/1984 | Fleischer et al. | |
| 4,549,767 | A | * | 10/1985 | Hampshire | A47C 16/025 297/423.46 |
| 4,561,649 | A | | 12/1985 | Forsythe | |
| 4,678,234 | A | | 7/1987 | Wilson | |
| D370,066 | S | | 5/1996 | Kennemore | |

(Continued)

FOREIGN PATENT DOCUMENTS

| | | | | | |
|---|---|---|---|---|---|
| GB | 2201142 | A | * | 8/1988 | A47L 23/16 |
| KR | 10-1396496 | B1 | | 5/2014 | |

OTHER PUBLICATIONS

International Search Report and Written Opinion dated Dec. 21, 2021 in PCT Application No. PCT/US2021/071309.

*Primary Examiner* — Tatiana L Nobrega
(74) *Attorney, Agent, or Firm* — Knobbe, Martens, Olson & Bear, LLP

(57) ABSTRACT

A pedicure foot stand has a housing with a first portion and a second portion defining an interior cavity. The second portion can be coupled in multiple configurations relative to the first portion, or can be decoupled from the first portion, to provide different angles at which a user's foot is supported on the second portion during a pedicure treatment.

15 Claims, 19 Drawing Sheets

(56) References Cited

U.S. PATENT DOCUMENTS

| | | | | |
|---|---|---|---|---|
| 5,749,377 | A | 5/1998 | Desario | |
| 5,870,837 | A | 2/1999 | Poulos | |
| 5,946,823 | A | 9/1999 | Yates | |
| 6,116,253 | A | 9/2000 | Armstrong | |
| 6,151,801 | A | 11/2000 | Frederiksen et al. | |
| 6,298,580 | B1 | 10/2001 | Tadayon | |
| 6,325,069 | B1 | 12/2001 | Heims | |
| 6,678,971 | B2 | 1/2004 | Brooks | |
| D487,533 | S | 3/2004 | Abbott et al. | |
| 6,832,688 | B1 * | 12/2004 | Rivera | A45D 44/04 132/286 |
| D551,803 | S | 9/2007 | Durante | |
| 7,354,110 | B1 | 4/2008 | Raghubir | |
| D587,507 | S | 3/2009 | Martin | |
| 7,648,108 | B2 | 1/2010 | Peterson | |
| 7,681,332 | B2 | 3/2010 | Allen | |
| 7,883,151 | B2 | 2/2011 | Behmer et al. | |
| D651,840 | S | 1/2012 | Davis, III | |
| D663,426 | S | 7/2012 | Davis, III | |
| 8,622,062 | B2 | 1/2014 | Dragos | |
| D767,148 | S | 9/2016 | Perreault | |
| 9,814,293 | B2 | 11/2017 | Houlder | |
| D824,695 | S | 8/2018 | Campilii | |
| 10,143,287 | B1 * | 12/2018 | Zorn | A61H 33/026 |
| D852,421 | S | 6/2019 | Solitt | |
| 2002/0108178 | A1 | 8/2002 | Francois | |
| 2002/0108627 | A1 * | 8/2002 | Nuzzo | A45D 29/22 132/286 |
| 2003/0047979 | A1 | 3/2003 | Carom | |
| 2004/0045568 | A1 | 3/2004 | Abbott et al. | |
| 2005/0285489 | A1 | 12/2005 | Brother | |
| 2006/0225240 | A1 * | 10/2006 | Rossiter | A47L 23/28 15/258 |
| 2006/0243291 | A1 | 11/2006 | Daley | |
| 2009/0189432 | A1 | 7/2009 | Anikin | |
| 2010/0115793 | A1 | 5/2010 | Kraisosky | |
| 2010/0251569 | A1 | 10/2010 | Stern | |
| 2010/0263237 | A1 | 10/2010 | Cuellar et al. | |
| 2014/0259772 | A1 | 9/2014 | Hazarian | |
| 2015/0351516 | A1 | 12/2015 | Doff et al. | |
| 2017/0086559 | A1 * | 3/2017 | Mulroy | A45D 29/00 |
| 2018/0235342 | A1 * | 8/2018 | Wesley | A45D 29/00 |
| 2018/0344000 | A1 * | 12/2018 | Humphrey | A45D 29/20 |
| 2019/0029389 | A1 | 1/2019 | Levy et al. | |
| 2019/0200722 | A1 | 7/2019 | Solitt | |
| 2020/0077765 | A1 | 3/2020 | Doff et al. | |

* cited by examiner

PEDICURE FOOT STAND

CROSS-REFERENCE TO RELATED APPLICATION(S)

This application claims the benefit of U.S. Provisional Application No. 63/082,279, filed Sep. 23, 2020, which is hereby incorporated by reference in its entirety. Any and all applications for which a foreign or domestic priority claim is identified in the Application Data Sheet as filed with the present application are hereby incorporated by reference under 37 CFR 1.57, and should be considered a part of this specification.

BACKGROUND

Field

Aspects of the present disclosure are directed to a pedicure foot stand to stabilize and orient a foot for a pedicure.

Description of the Related Art

Pedicure foot stands are usually provided attached to a manicure and/or pedicure chair that are often found in nail salons. However, this can have several drawbacks. For example, these are attached to a larger structure, such as a chair or stool, and is therefore not practical for various locations outside of a salon and is not portable. The foot stands can be fixed and therefore not adjustable for the particular user's anatomy or desired use. Moreover, these are oriented to position the foot to allow others, such as nail professionals, to provide pedicure services, such as nail cutting and shaping or applying polish. Further, foot stands built into chairs or other structures can have a limited range of orientation, which can be based on the attachment to the structure or the limited space provided. Another drawback is that these foot stands often do not provide storage for pedicure tools and supplies. Another drawback is that these foot stands are not available for individual home use.

SUMMARY

Accordingly, there is a need for an improved pedicure foot stand or kit, and that can be portable and used, for example, at home or while traveling. Disclosed herein are embodiments of pedicure foot stands to position a user's foot for a pedicure. Advantageously, the pedicure foot stand provides various angles to position the user's foot for ease and convenience of the user. The pedicure foot stand overcomes at least some of the drawbacks of existing applicators discussed above.

In accordance with one aspect of the disclosure, a pedicure stand is provided that is adjustable between three different configurations in which a user's foot can be supported at three different angular positions during a pedicure treatment.

In accordance with another aspect of the disclosure, a pedicure foot stand is provided. The pedicure foot stand comprises a housing comprising a first portion and a second portion defining an interior cavity therebetween. The first portion is removably coupled to the second portion. The first portion has a first bottom end and a first top end angled relative to the first bottom end at a first angle, the first bottom end of the first portion defining a bottom surface. The second portion has a second top end and a second bottom end angled relative to the second top end at a second angle, the second top end of the second portion defining a top surface. The top surface configured to support and orient a foot of a user. The second portion is configured to be coupled to the first portion in different configurations to vary an angle of the top surface of the second portion relative to the bottom surface of the first portion.

In accordance with another aspect of the disclosure, a pedicure kit is provided. The pedicure kit comprises a pedicure foot stand that has an interior cavity, and a plurality of pedicure tools stored in the interior cavity. The pedicure foot stand comprises a housing comprising a first portion and a second portion defining the interior cavity therebetween. The first portion is removably coupled to the second portion. The first portion has a first bottom end and a first top end angled relative to the first bottom end at a first angle, the first bottom end of the first portion defining a bottom surface. The second portion has a second top end and a second bottom end angled relative to the second top end at a second angle, the second top end of the second portion defining a top surface. The top surface configured to support and orient a foot of a user. The second portion is configured to be coupled to the first portion in different configurations to vary an angle of the top surface of the second portion relative to the bottom surface of the first portion.

DETAILED DESCRIPTION

Figure 1A:
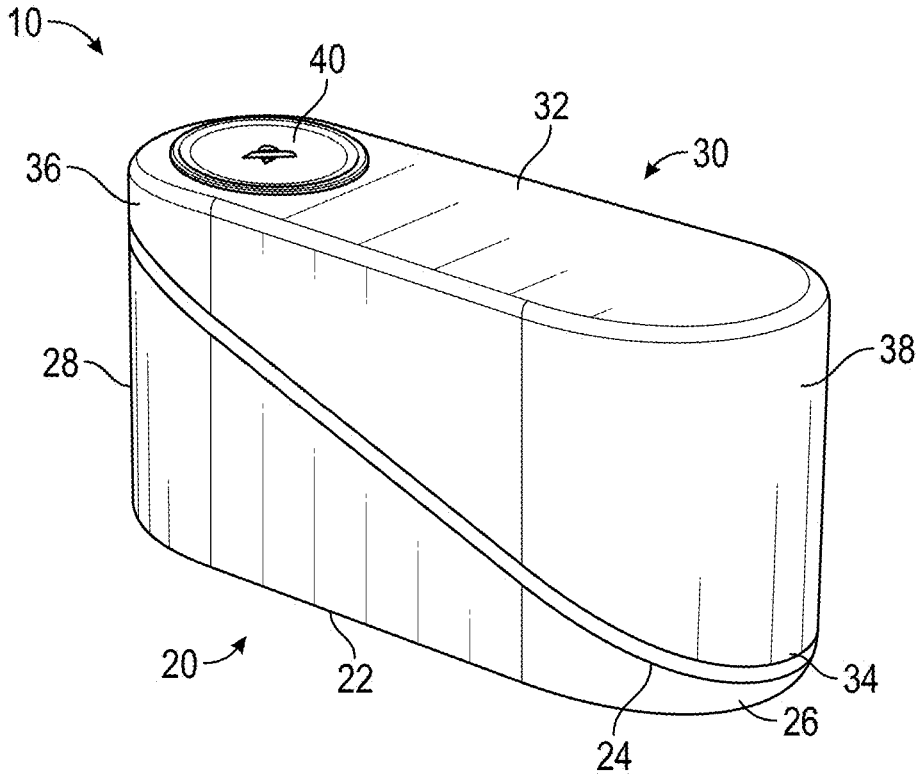
FIG. 1A is perspective view of one embodiment of a pedicure foot stand or kit in a first configuration.
Figure 1B:
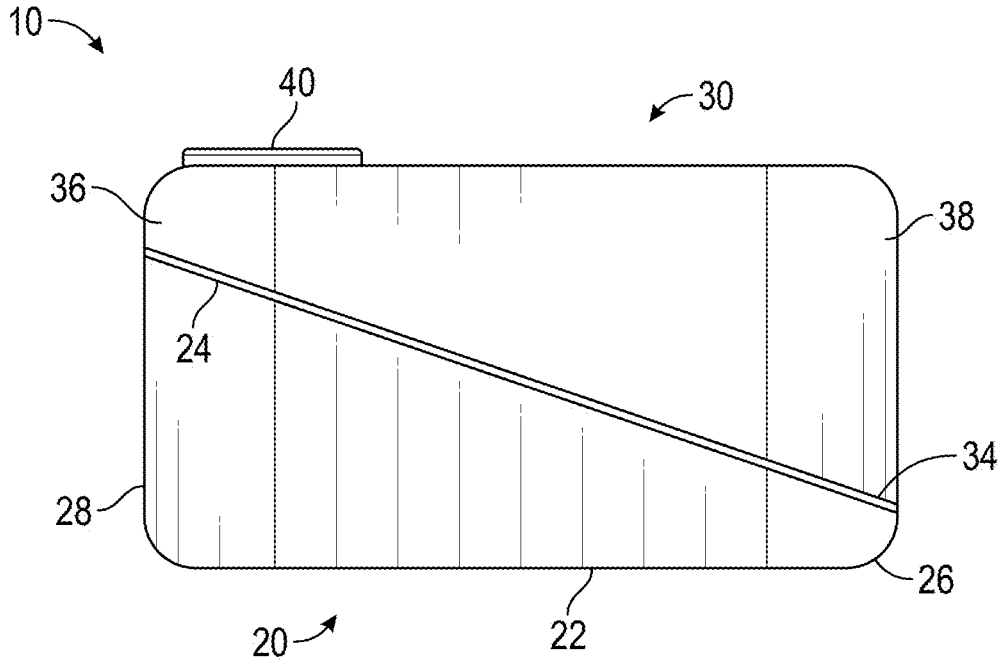
FIG. 1B is a side view of pedicure foot stand or kit of FIG. 1A.
Figure 1C:
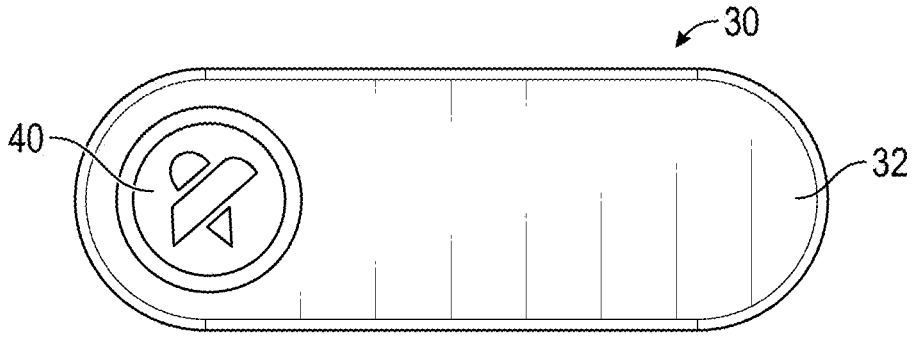
FIG. 1C is a top view of pedicure foot stand or kit of FIG. 1A.

Disclosed herein are several embodiments of a pedicure foot stand or kit 10. FIGS. 1A-1C shows one embodiment of an pedicure foot stand or kit 10 in a first configuration. The pedicure foot stand or kit 10 can include a first or bottom portion 20 and a second or top portion 30. The first portion 20 can also be called a bottom housing. The second portion 30 can also be called a top housing. The housing can be made of a stiff or hard material (e.g., plastic, polypropylene, or a metal).

The first portion 20 can have a top side or end 24. The first portion 20 can have a bottom side or end 22 which may be a bottom surface configured to be placed on a flat surface, such as the floor. The bottom side 22 of the first portion 20 can be enclosed with a bottom planar surface. The top side 24 of the first portion 20 can be open (e.g., define an opening). The first portion 20 can contain side walls (e.g., sides 26, 28 described below) that extend between the bottom side 22 and the top side 24. At least a portion of the side walls can be rounded. The bottom planar surface and side walls that define an interior cavity that is accessed through the open top side 24. The open top side 24 can be defined by the ends of the side walls (e.g., sides 26, 28). The top side 24 can include a flange or ridge that extends around the perimeter of the first portion 20.

The second portion 30 can have a first or top side 32 which may be a top surface configured to receive or position a user's foot. The top side 32 of the second portion 30 can define a top planar surface. The second portion 30 can have a second or bottom side or end 34. The bottom side 34 of the second portion 30 can be open (e.g., define an opening). The second portion 30 can contain side walls (e.g., sides 36, 38 described below) that extend between the bottom side 34 and the top side 32. At least a portion of the side walls can be rounded. The top planar surface and side walls that define an interior cavity that is accessed through the open bottom side 34. The open bottom side 34 can be defined by the ends of the side walls (e.g., sides 36, 38). The bottom side 34 can include a flange or ridge that extends around the perimeter of the second portion 30 (see FIG. 3C). The second portion 30 can optionally have a heel pad 30 on the top side or surface 32. The heel pad 40 can optionally be made of a different material than the rest of the top side or surface 32. The heel pad 40 may optionally be made of a compressible or soft material (e.g., foam, rubber, silicone, etc.), which is at least softer than the rigid material of the housing. The heel pad 40 can provide comfort to the user's heel, guide the user's foot into the desired position, and provide grip to the user's foot on the pedicure foot stand 10 (e.g., to inhibit or prevent the user's foot from sliding or shifting while on the foot stand 10 during a pedicure).

A top side or edge 24 of the first portion 20 can be angled relative to the bottom side 22, such that the first portion 20 includes a long side 28 and a short side 26. In some examples, the top side 24 of the first portion 20 can be approximately 30 degrees relative to the bottom side 22 of the first portion 20. In other examples, the angle of the top side 24 relative to the bottom side 22 of the first portion 20 can be approximately 10, 15, 20, 25, 30, 35, 40 or 45 degrees.

Similarly, a bottom side or edge 34 of the second portion 30 can be angled relative to the top side 32, such that the second portion 30 includes a long side 38 and a short side 26. In some examples, the top side 32 can be approximately 30 degrees relative to the bottom side 34 of the second portion 30. In other examples, the angle of the top surface 32 relative to the bottom side or edge 34 is approximately 10, 15, 20, 25, 30, 35, 40 or 45 degrees.

In some examples, the angle of the top side 24 relative to the bottom side 22 of the first portion 20 can match (e.g., be approximately equal to, be the same as, etc.) the angle of the top side 32 relative to the bottom side 34 of the second portion 30. In other examples, the angle of the top side 24 relative to the bottom side 22 of the first portion 20 can be different from the angle of the top side 32 relative to the bottom side 34 of the second portion 30. In still another implementation, the angle of the top side 24 of the first portion 20 and the angle of the bottom side 34 of the second portion 30 can be chosen so that they add up to approximately 90 degrees (e.g., so that when the second portion 30 is coupled to the first portion 20 in one configuration the top side 32 extends substantially horizontally when the housing sits on a flat horizontal surface).

As shown in FIGS. 1A-1C, the first portion 20 and the second portion 30 can be joined at a top side 24 of the first portion and the bottom side 34 of the second portion 30. The first portion 20 and the second portion 30 can be combined or joined together to form a carrying case, which is approximately rectangular when viewed from the side (such as shown in FIG. 1B). The angled top side 24 of the first portion 20 can be joined to the angled bottom side 34 of the second portion 30. The short side 26 of the first portion 20 can be aligned with the long side 38 of the second portion 30 and the long side 28 of the first portion 20 can be aligned with the short side 36 of the second portion 30.

The first portion 20 and the second portion 30 can be repositioned or removed from one another or be repositioned relative to one another, such that the pedicure foot stand 10 has several possible configurations (e.g., angular configurations). In the first configuration (see e.g. FIG. 1B), a user's foot can be placed on the top surface 32 of the second portion 30. The top surface 32 can have a length that accommodates the user's entire foot thereon (e.g., so the user's foot does not protrude past an end of the top surface 32). This can allow a user to stabilize and elevate the foot for a pedicure. The user's heel can be placed on the heel pad 40. The top surface 32 of the pedicure foot stand 10 can be oriented substantially parallel to the bottom surface 22 or to the surface on which the pedicure foot stand 10 is placed. The top surface 32 can therefore be oriented at approximately 0 degrees (e.g., horizontally) relative to the bottom surface 22 or to the surface on which the pedicure foot stand 10 is placed. In the first configuration, the short side 26 of the first portion 20 and the long side 38 of the second portion 30 are adjacent to each other, while the long side 28 of the first portion 20 and the short side 36 of the second portion are adjacent each other.

Figure 1D:
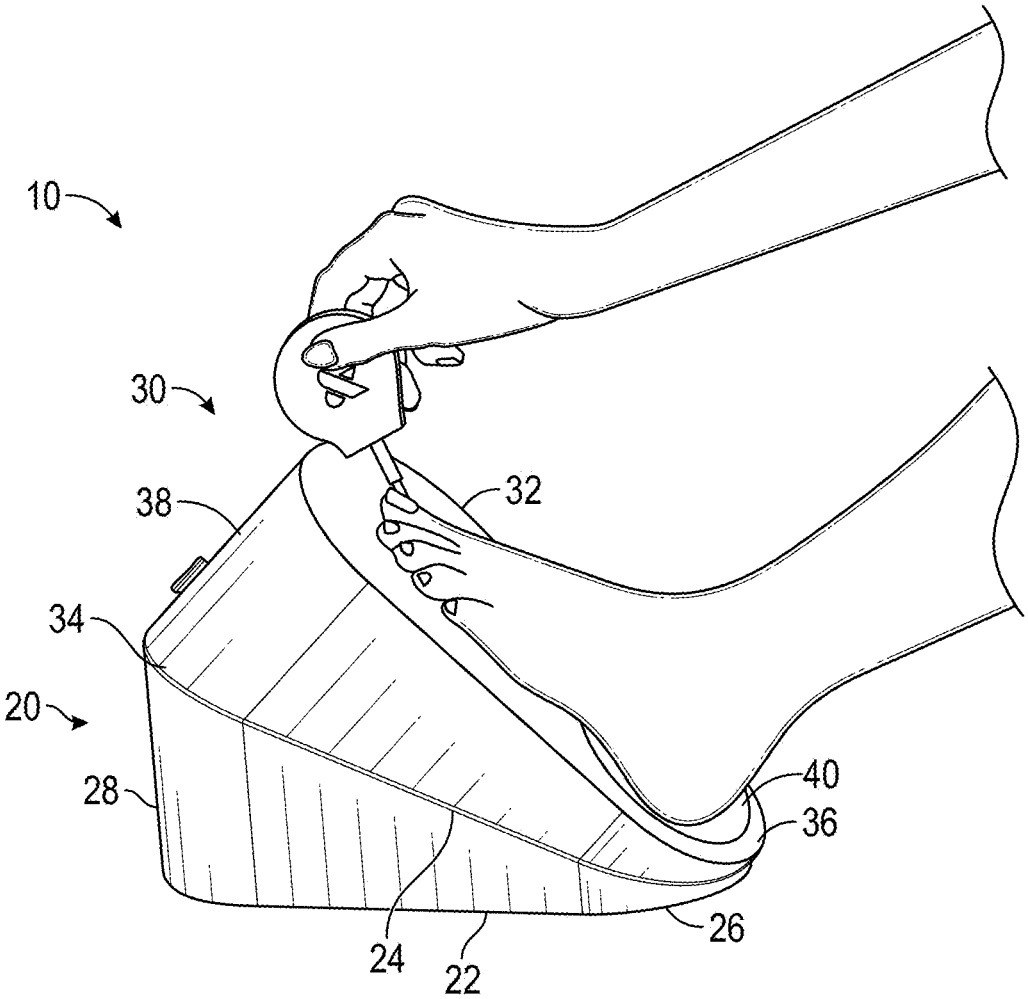
FIG. 1D is a perspective view of the pedicure foot stand or kit in a second configuration.

FIG. 1D shows the pedicure foot stand or kit 10 in a second configuration. In the second configuration, the second portion 30 has been rotated 180 degrees compared to the first configuration. In the second configuration, the short side 26 of the first portion 20 and the short side 36 of the second portion 30 are adjacent each other, while the long side 28 of the first portion 20 and the long side 38 of the second portion 30 are adjacent each other. This can provide an acute or steep angle (e.g., greater than 0 degrees but less than 90 degrees) of the top surface 32 of the pedicure foot stand 10 relative to the bottom surface 22 or the surface on which the pedicure foot stand 10 is placed. The second configuration conveniently positions and orients the user's foot for a pedicure at an angle and at an elevated height, which can advantageously facilitate the application of nail polish or performance of other pedicure steps. In some examples, the top surface 32 of the pedicure foot stand 10 is approximately 45 degrees relative to the bottom surface 22 or to the surface on which the pedicure foot stand is placed. In other examples, the angle of the top surface 32 in the second configuration is approximately 30, 35, 40, 45, 50, 55 or 60 degrees.

Figure 1E:
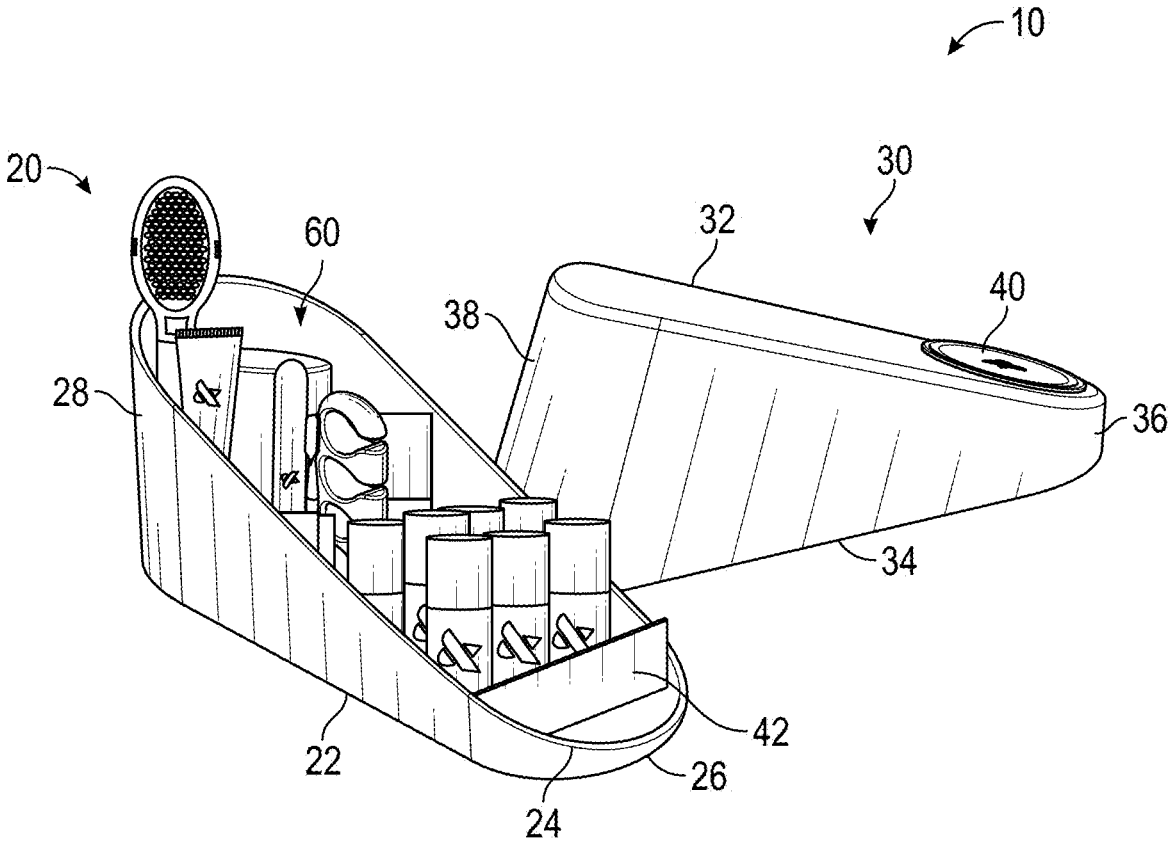
FIG. 1E is a perspective view of the pedicure foot stand or kit in a third configuration and various components of a pedicure foot stand or kit.

FIG. 1E shows a pedicure foot stand or kit 10 in a third configuration. In the third configuration, the first portion 20 and the second portion 30 have been separated (e.g., completely separated). The second portion 30 can be placed on a flat surface, such that the bottom side or edge 34 can be placed on a flat surface, such as the ground. The top surface 32 is thus angled relative to the bottom side 34 or the surface on which the first portion 20 is positioned on. This can provide an angled top surface 32 to position a user's foot for a pedicure. The third configuration conveniently positions and orients the user's foot for a pedicure at an angle and at an elevated height. This advantageously provides a different angle and different height for positioning the user's foot from the first and second configurations as described above. In one implementation, the angle of the top surface 32 relative to the bottom side 34 in the third configuration is greater than the angle of the top surface 32 relative to the bottom surface 22 in the first configuration, and less than the angle of the top surface 32 relative to the bottom surface 22 in the second configuration. In one implementation, the angle of the top surface 32 relative to the bottom side 34 in the third configuration is approximately ½ of the angle of the top surface 32 relative to the bottom surface 22 in the second configuration. In one implementation, the height of the top surface 32 in the second configuration is greater than the height of the top surface 32 in the third configuration. Additionally, the height of the top surface 32 in the second configuration at its tallest point can be greater than the height of the top surface 32 in the first configuration at its tallest point. Accordingly, the foot stand 10 advantageously provides at least three foot orientations and heights during a pedicure, allowing the user to position the second portion 30 of the foot stand 10 as they prefer (e.g., in the position most comfortable for their feet) for use in performing a pedicure.

Figure 2:
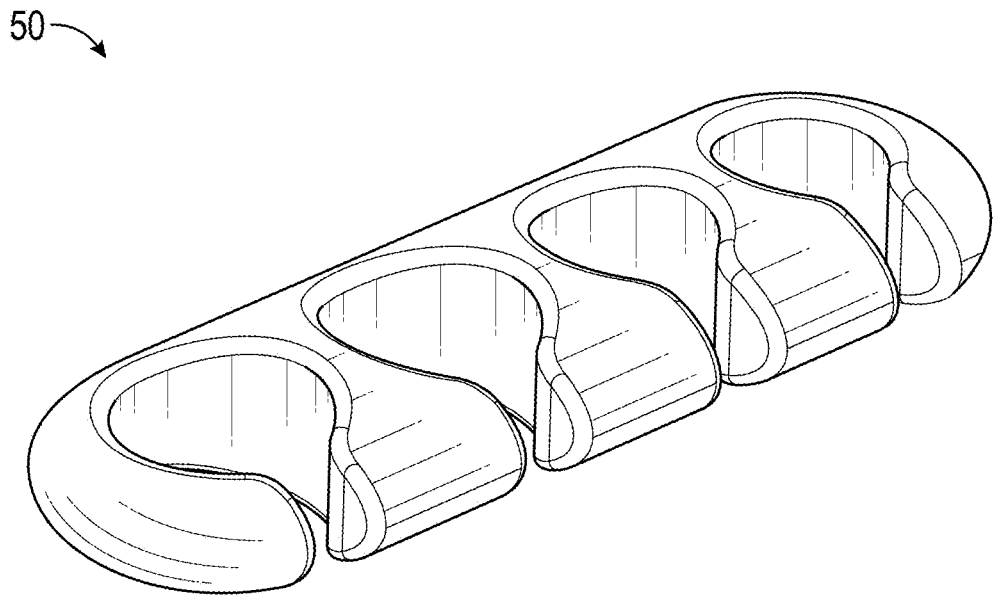
FIG. 2 is a perspective view of a toe separator.

The first portion 20 can define a cavity therein to store components, such as components of a pedicure kit including pedicure tools and supplies 60. The first portion 20 can include one or more interior protrusions 42 extending from the underside of the bottom surface 22. As shown in FIG. 1E, there is at least one interior protrusion 42 positioned near the short side 36 of the first portion 20. This can further define the interior cavity or space of the first portion 20 and retain the components within the interior space. In some examples, the components can include one or more of the following: nail polish remover, cuticle coil, cuticle cream, cuticle serum, foot or hand serum, cuticle remover, lotions, pushers, nippers, buffers, files, pumice stones, nail polish, clippers, toe separators or spacers, towels, cotton rounds or balls, brushes, foot files or callus removers, or other tools. FIG. 2 shows a toe separator or spacer 50 that can be included in the pedicure kit and stored within the cavity of the first portion 20. Though not shown, a user can place the toe separator 50 between their toes prior to placing their foot on the foot stand 10 for performing a pedicure.

Figure 3A:
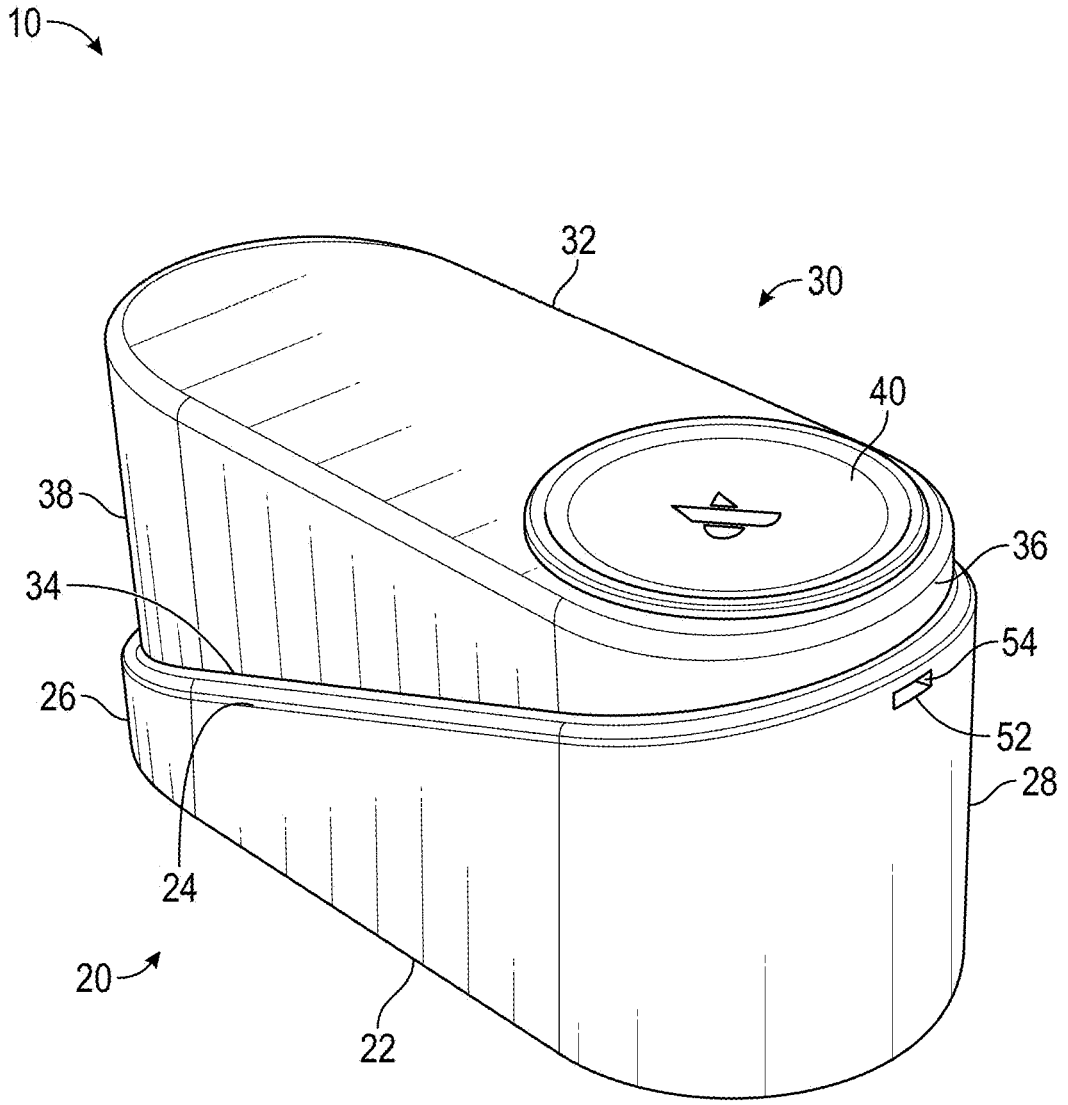
FIG. 3A is perspective view of another embodiment of a pedicure foot stand or kit in a first configuration.
Figure 3B:
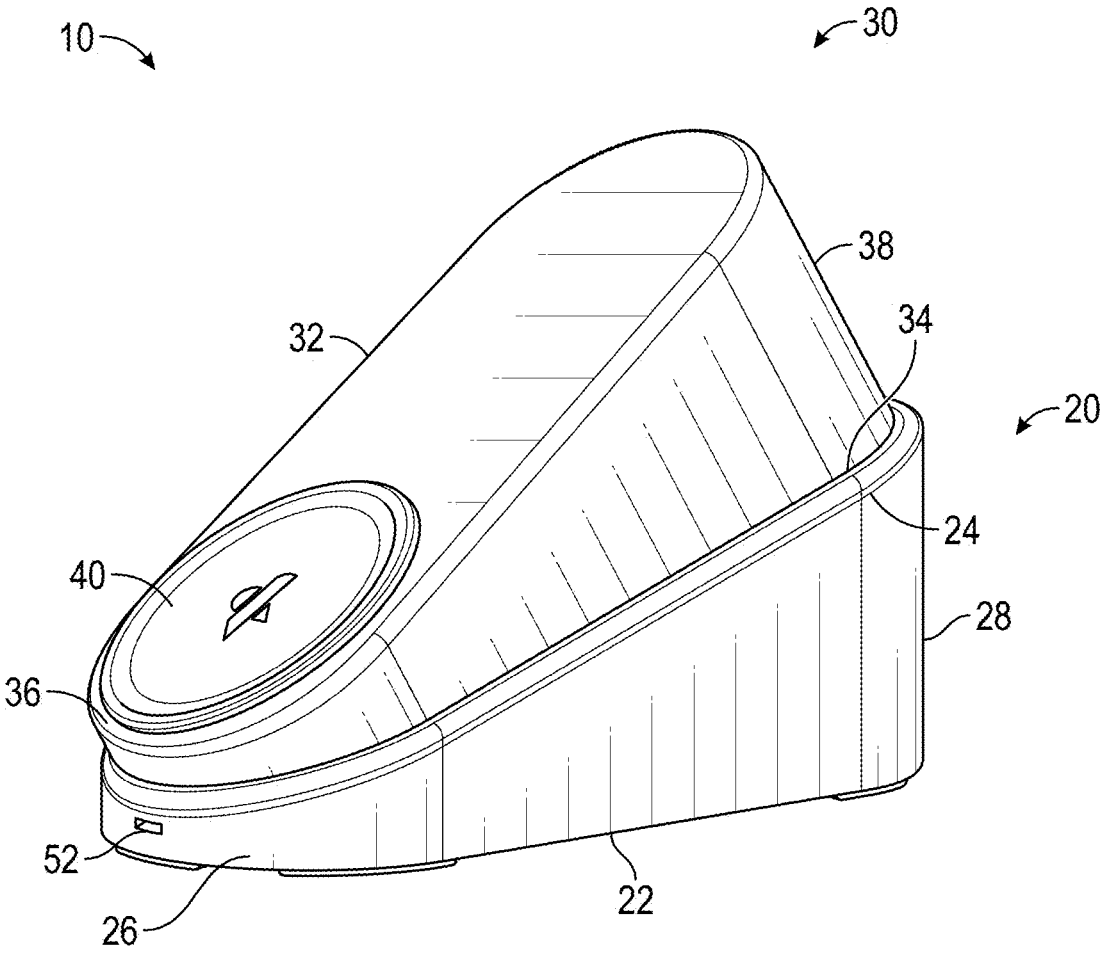
FIG. 3B is perspective view of the pedicure foot stand or kit of FIG. 3A in a second configuration.
Figure 3C:
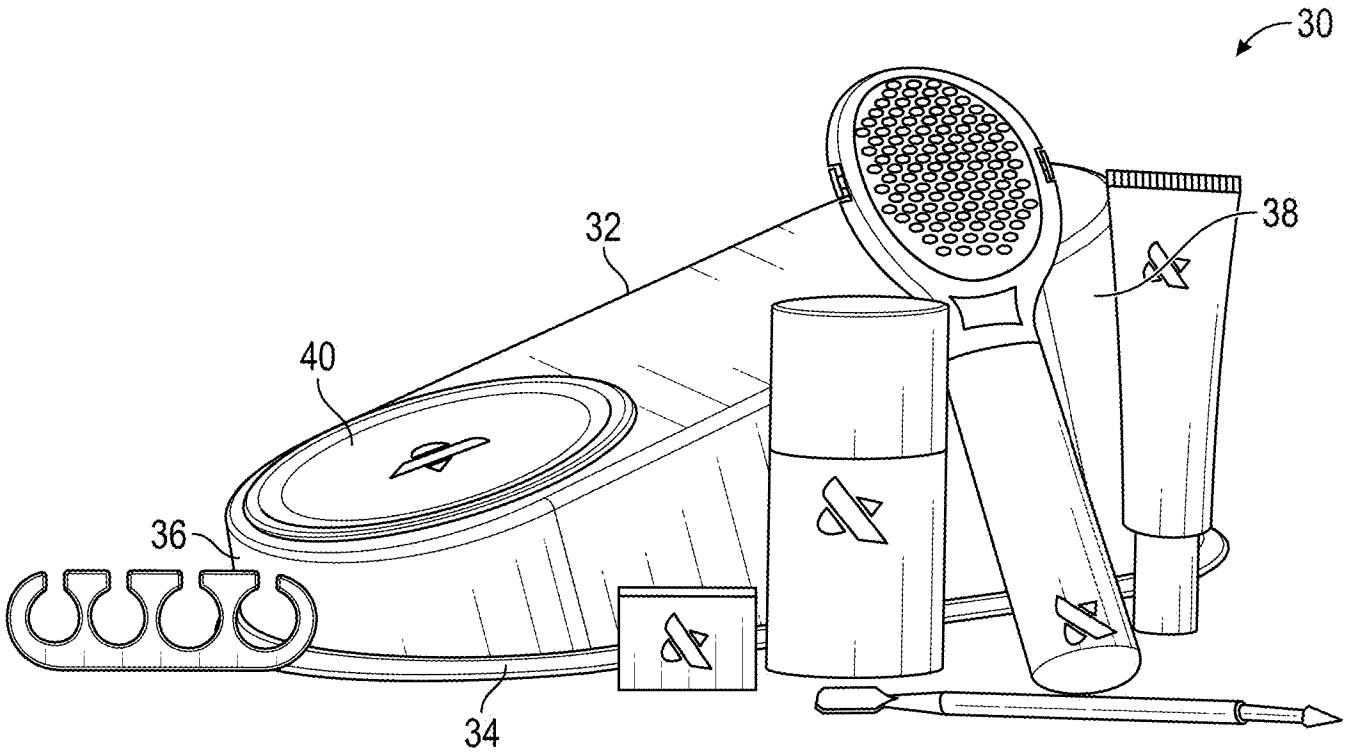
FIG. 3C is a perspective view of the first portion of the pedicure foot stand or kit of FIG. 3A in a third configuration and various components of the pedicure foot stand or kit.

FIG. 3A shows another embodiment of a pedicure foot stand or kit 10 in the first configuration. FIG. 3B shows the pedicure foot stand or kit 10 of FIG. 3A in a second configuration. FIG. 3C shows the first portion of the pedicure foot stand or kit 10 in a third configuration and various components of the pedicure foot stand or kit 10.

The first portion 20 and the second portion 30 can be interlocked together via snap fit on a first side in the first configuration, as shown in FIG. 3A. The first portion 20 can include a recess 52 on the wall of the long side 28. The second portion 30 can include a protrusion 54 extending from the wall of the short side 36. The recess 52 can receive the protrusion 54 to interlock the first portion 20 and the second portion 30. As will be discussed further below, the first portion 20 and the second portion 30 alternatively or additionally be interlocked on a second side in the first configuration, on the short side 26 of the first portion 20 and the long side 38 of the second portion 30.

The top side or edge 24 of the first portion 20 and/or the bottom side or edge 34 of the second portion 30 can include a flange or ridge. The flange or ridge can extend around the perimeter of the first portion 20 or the second portion 30. The flange or ridge of the bottom side 34 can advantageously allow the second portion 30 to rest on the flange or ridge of the top side 24 of the first portion 20, thus preventing the second portion 30 from being positioned (or fall) within the interior cavity of the first portion 20 or preventing the first portion from being positioned (or fall) within the interior cavity of the second portion 30. In particular, this can be advantageous when weight (such as a user's foot) is applied to the top surface 32 of the second portion 30 in the first and second configurations. The flange or ridge of the bottom side 34 can also advantageously allow the second portion 30 to rest on a flat surface, such as the ground, when in the third configuration, thus preventing the sides or walls of the second portion 30 from becoming deformed when weight is applied to the top surface 32 of the second portion 30 in the third configuration.

FIG. 4A-4I shows another embodiment of a pedicure foot stand or kit 10 in the first configuration.

The first portion 20 and the second portion 30 can be interlocked in various places and in various ways, such as on the front side or on the rear side. As shown in FIGS. 4B and 4E, the first portion 20 and the second portion 30 can be interlocked together via snap fit on the rear side in the first configuration. The first portion 20 can include a recess 52 on the wall of the long side 28. The second portion 30 can include a protrusion 54 extending from the wall of the short side 36. The recess 52 can receive the protrusion 54 to interlock the first portion 20 and the second portion 30.

Figure 4A:
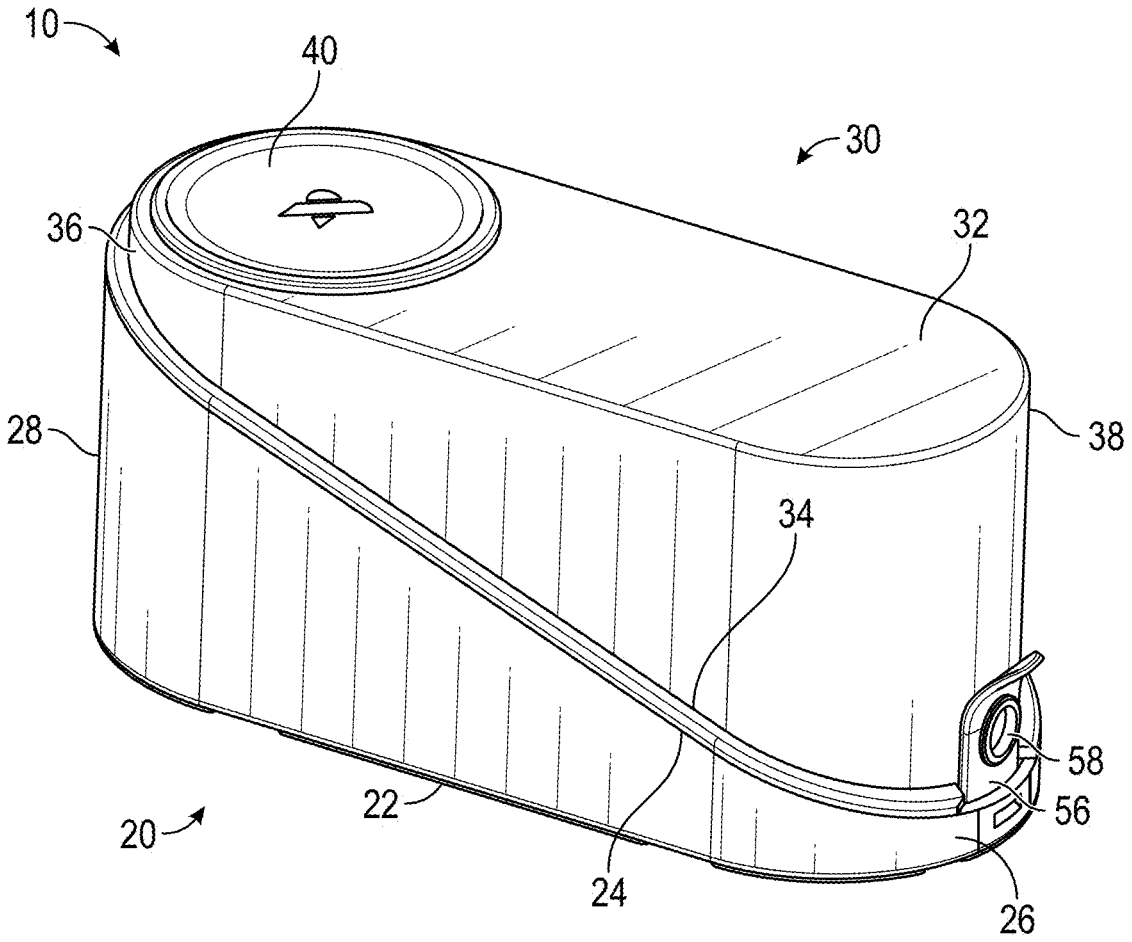
FIG. 4A is perspective view of yet another embodiment of a pedicure foot stand or kit in a first configuration showing the top surface.
Figure 4B:
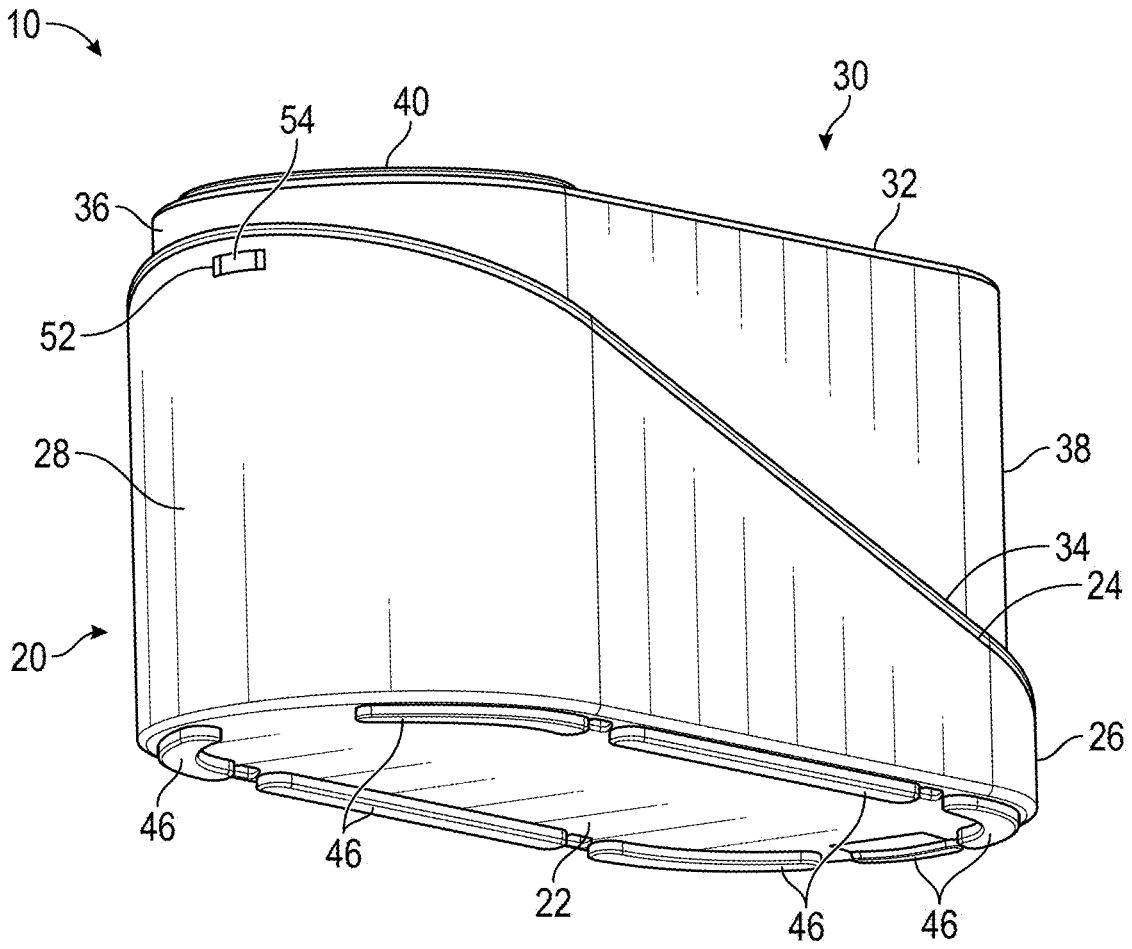
FIG. 4B is a perspective view of pedicure foot stand or kit of FIG. 4A showing the bottom surface.
Figure 4C:
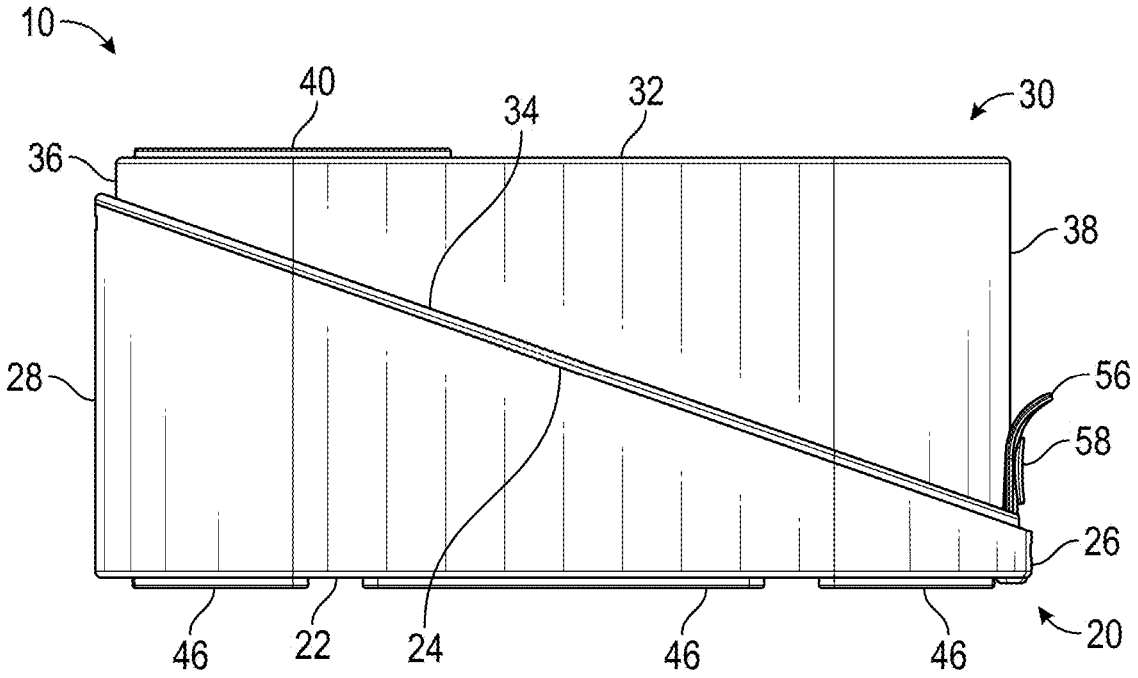
FIG. 4C is a right view of pedicure foot stand or kit of FIG. 4A.
Figure 4D:
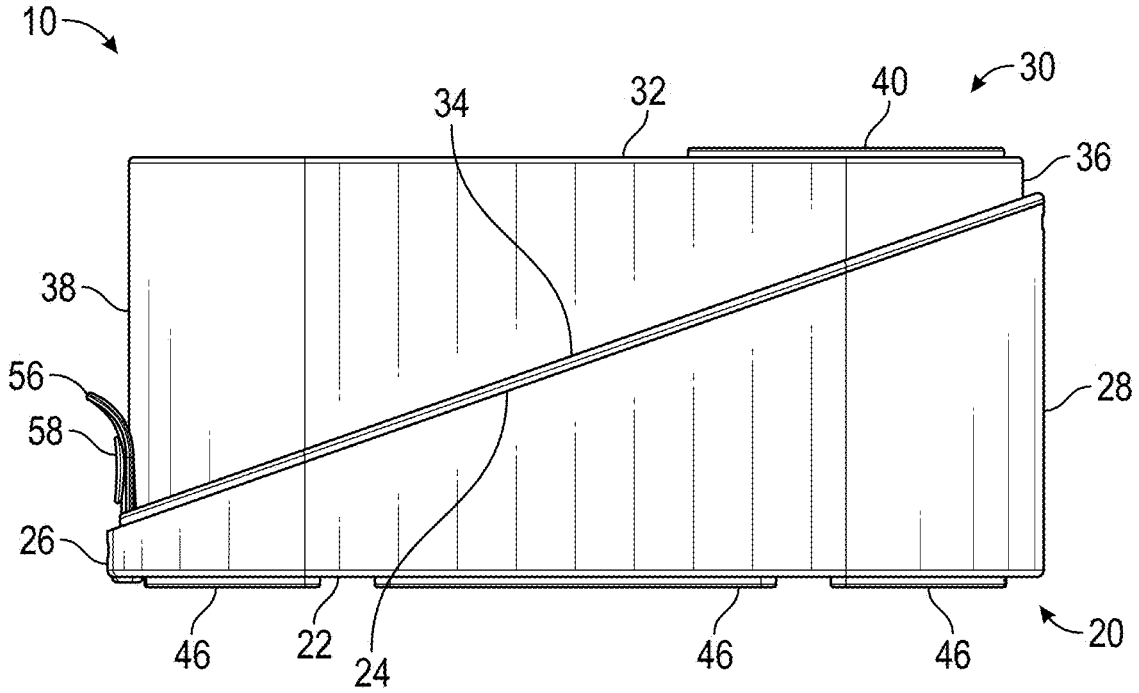
FIG. 4D is a left view of pedicure foot stand or kit of FIG. 4A.
Figure 4E:
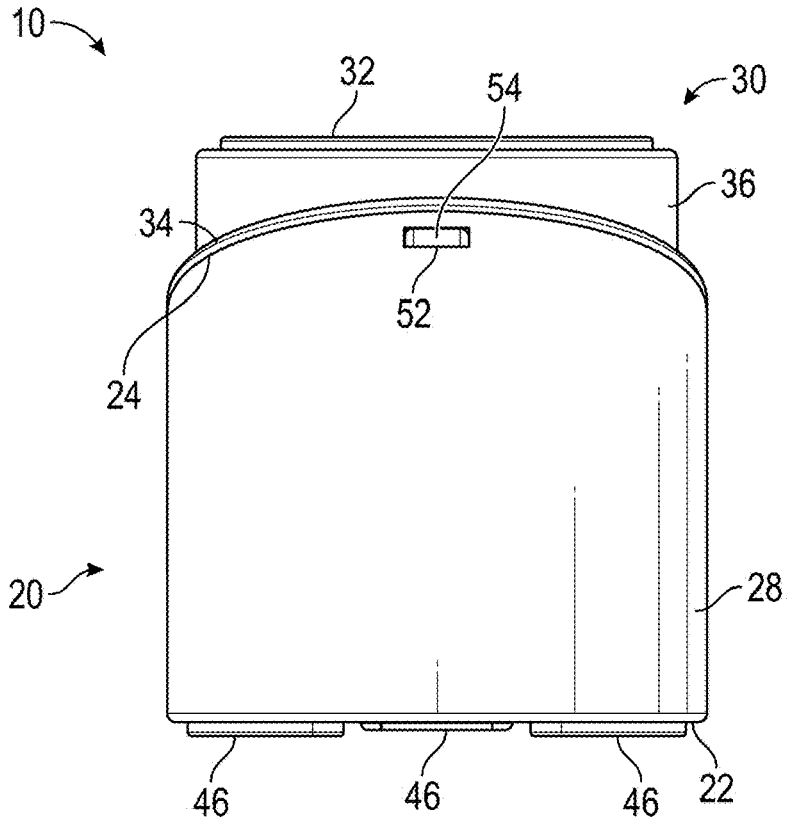
FIG. 4E is a rear view of pedicure foot stand or kit of FIG. 4A.
Figure 4F:
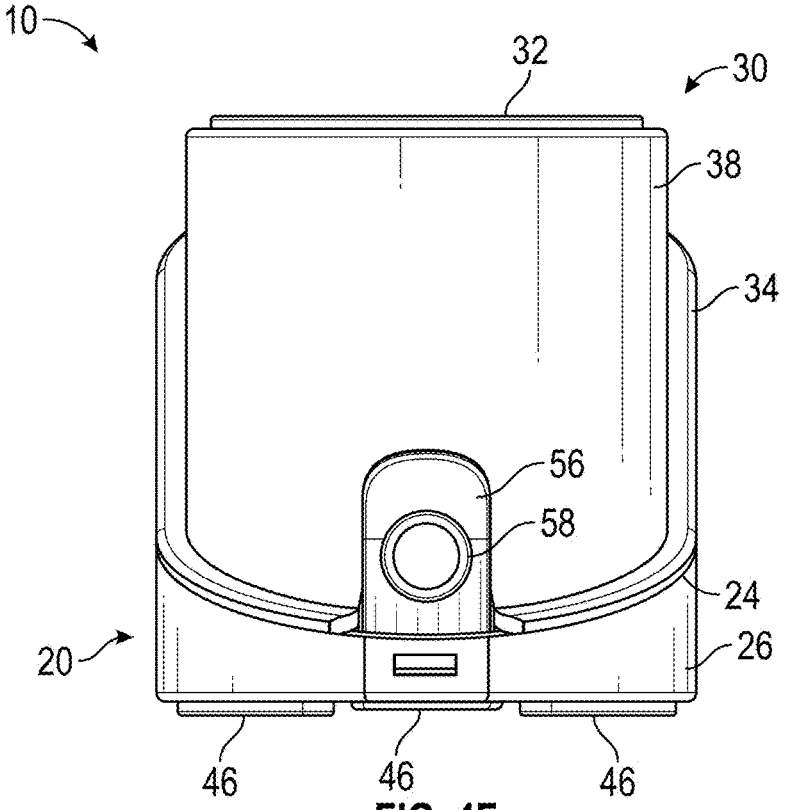
FIG. 4F is a front view of pedicure foot stand or kit of FIG. 4A.
Figure 4G:
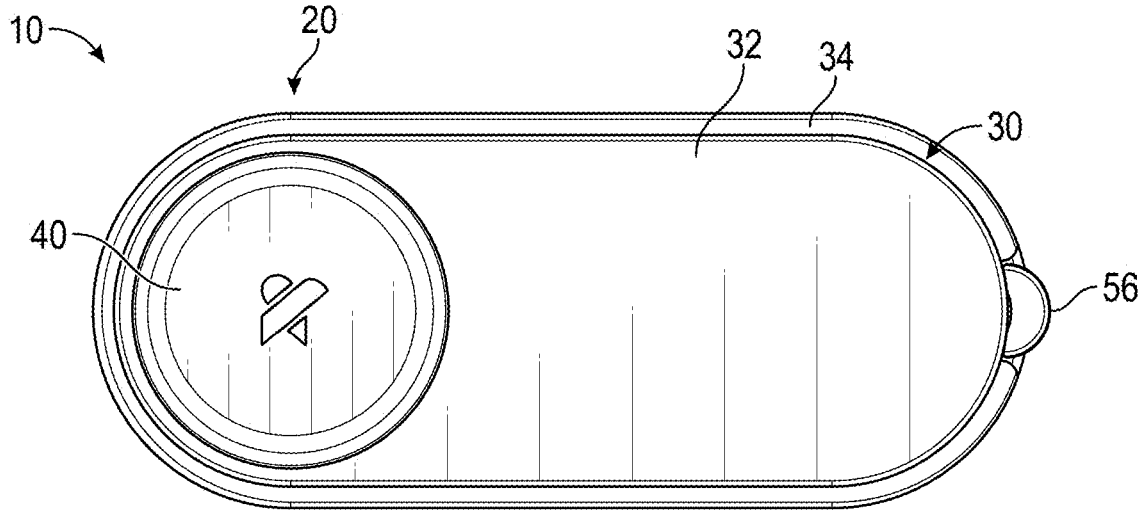
FIG. 4G is a top view of pedicure foot stand or kit of FIG. 4A.
Figure 4H:
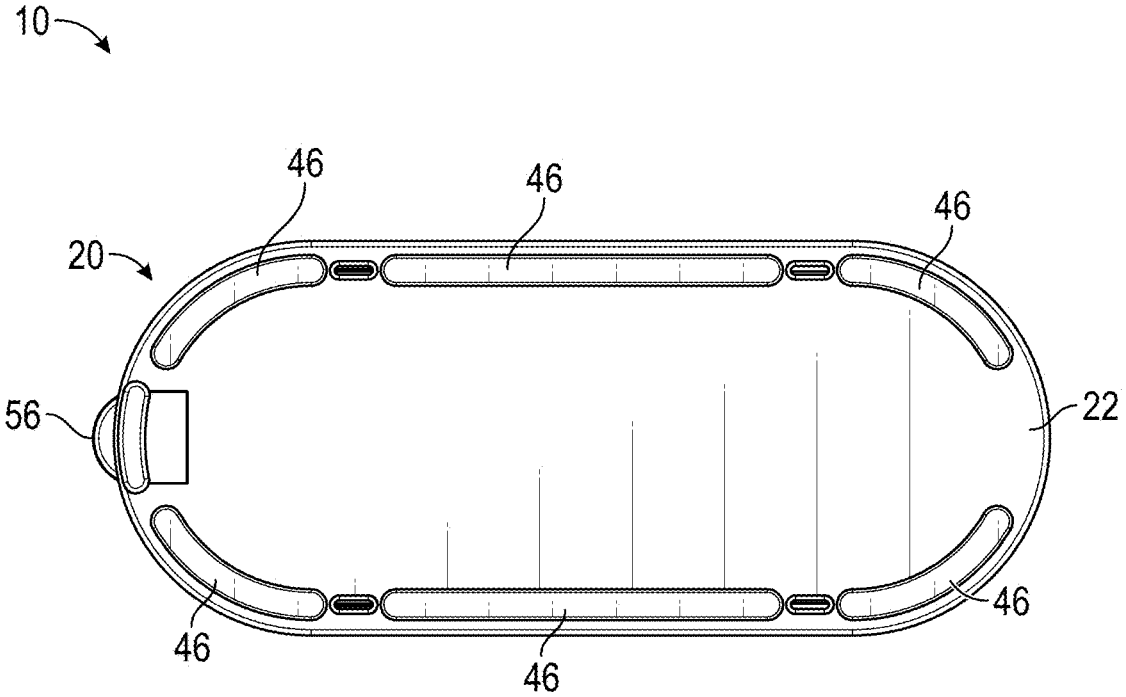
FIG. 4H is a bottom view of pedicure foot stand or kit of FIG. 4A.
Figure 4I:
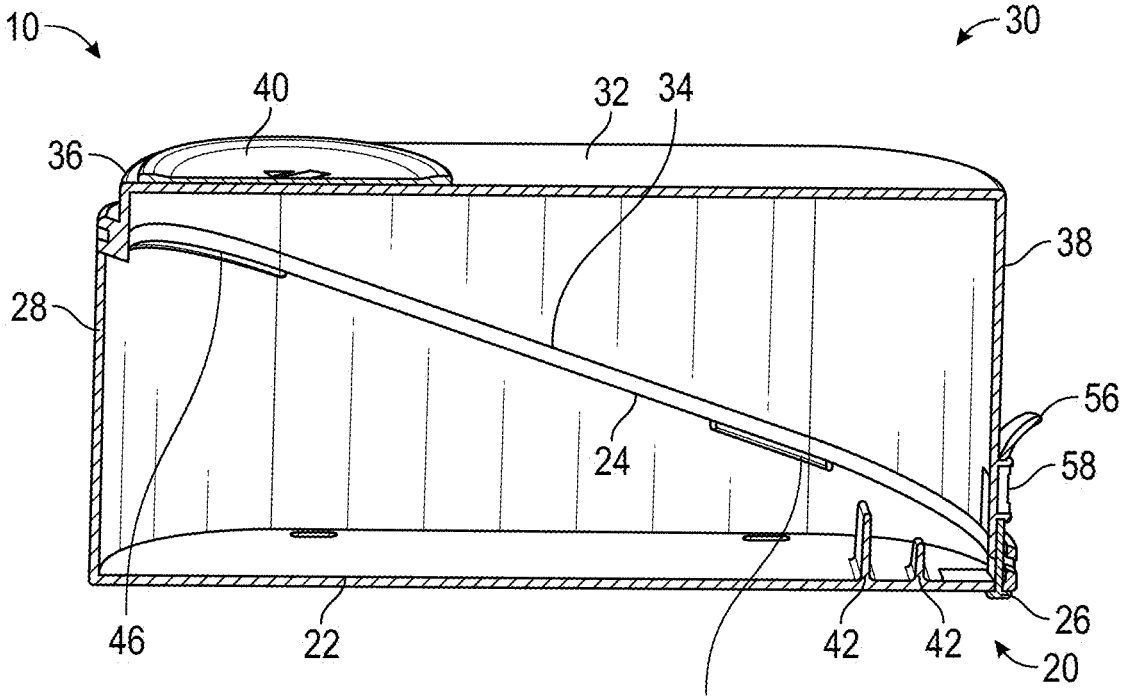
FIG. 4I is a cross sectional view along the length of the pedicure foot stand or kit of FIG. 4A.
Figure 4J:
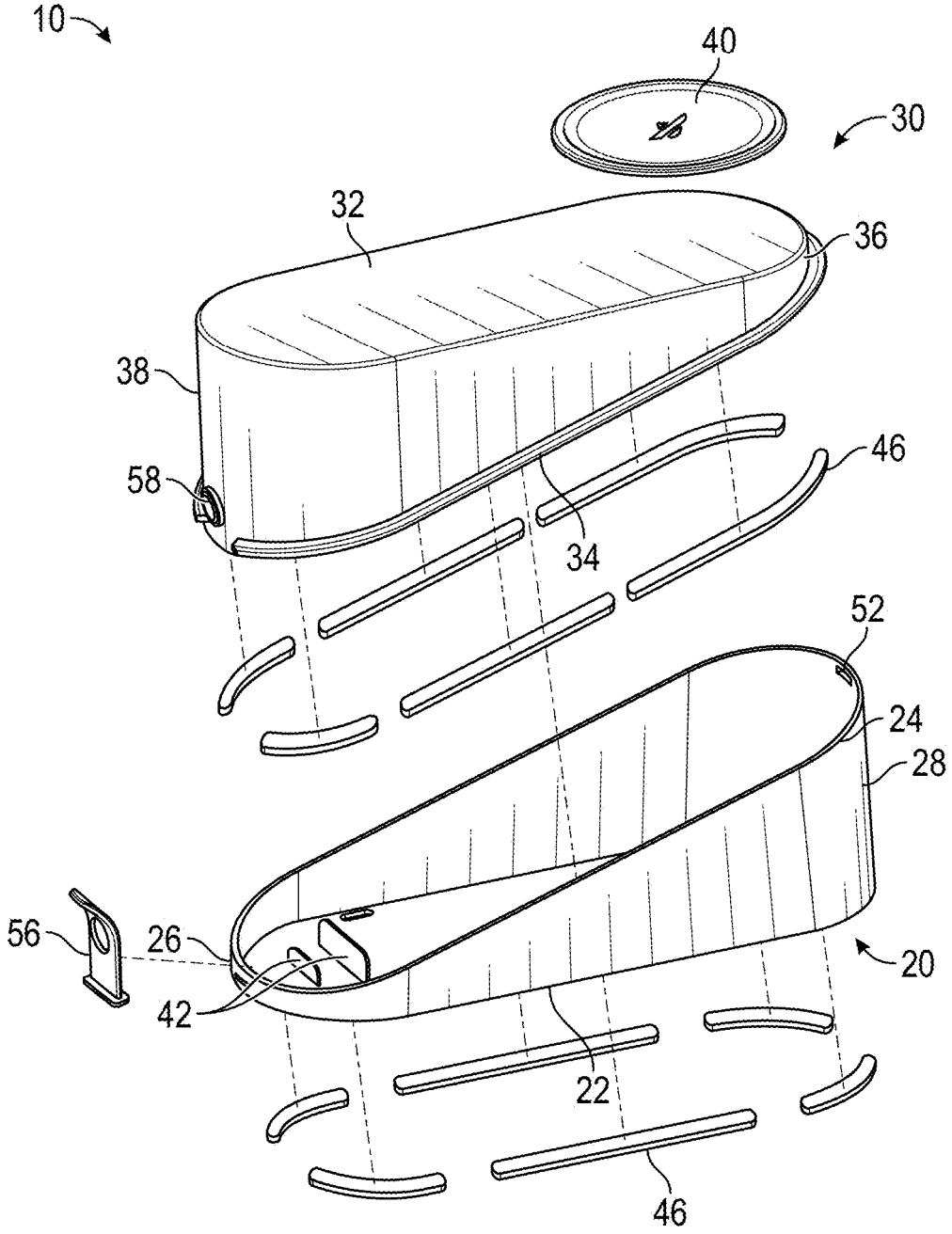
FIG. 4J is an exploded view of the pedicure foot stand or kit of FIG. 4A.

Additionally or alternatively, the first portion 20 and the second portion 30 can be interlocked via snap fit on the front side in the first configuration, as shown in FIGS. 4A and 4F. The first portion 20 can have a clip 56 which extends from the short side 26. The second portion 30 can include a protrusion 58 that extends from the surface of the wall of the long side 38. The clip 56 can include a recess shaped to receive the protrusion 58 to interlock the first portion and the second portion 30. The clip 56 can advantageously have a surface which allows the user to pull the clip 56 away from the surface of the wall of the pedicure kit 10, such that the recess of the clip 56 can disengage the protrusion 58. This can allow the user to easily disengage the interlocked portions of the pedicure kit to separate the first and second portions 20, 30.

As shown in FIGS. 4B-4F and 4H-4K, the bottom surface 22 of the first portion 20 or the bottom surface 34 of the second portion 30 can include one or more grips 46 that frictionally engage a support surface on which the first portion 20 (or second portion 30 if decoupled from the first portion 20) is placed to inhibit (e.g., prevent) the pedicure foot stand 10 (or second portion 30 if decoupled from the first portion 20) from moving or sliding. The one or more grips 46 can also protect the surface on which the pedicure foot stand 10 is placed. In some examples, the one or more grips 46 can be made of a soft or compressible material (e.g. rubber, silicone, etc.), which is at least softer than the rigid material of the housing.

Figure 4K:
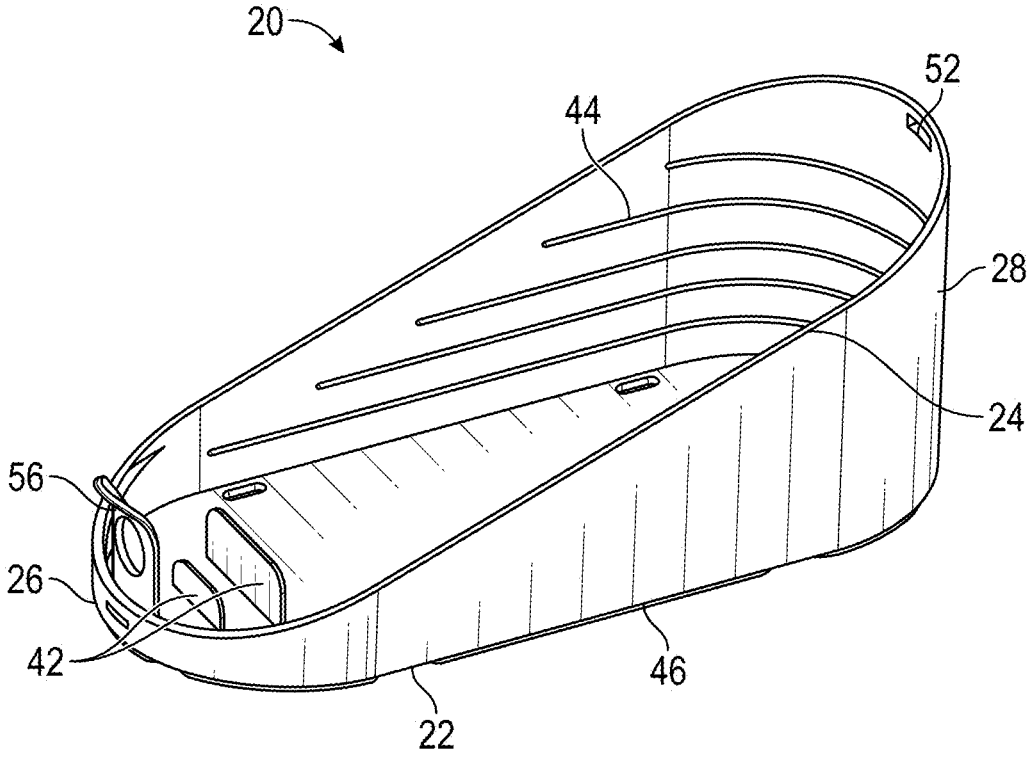
FIG. 4K is a perspective view of a portion of the pedicure foot stand or kit of FIG. 4A.

As shown in FIG. 4K the inner surface of the first portion 20 can include one or more ribs 44 to reinforce the walls of the first portion 20 to prevent the walls of the first portion from caving in or buckling. The one or more ribs 44 can advantageously protect the walls of the long side 28 of the first portion 20 in particular. In some embodiments, the ribs can be made of the same or different material as the walls of the first portion 20. As shown in FIG. 4K, the one or more ribs 44 extend horizontally along the inner surface of the first portion 20. Other configurations of the ribs 44 are also possible. Additionally, one or more ribs 44 could also be included on the inner surface of the second portion 30.

Figure 5A:
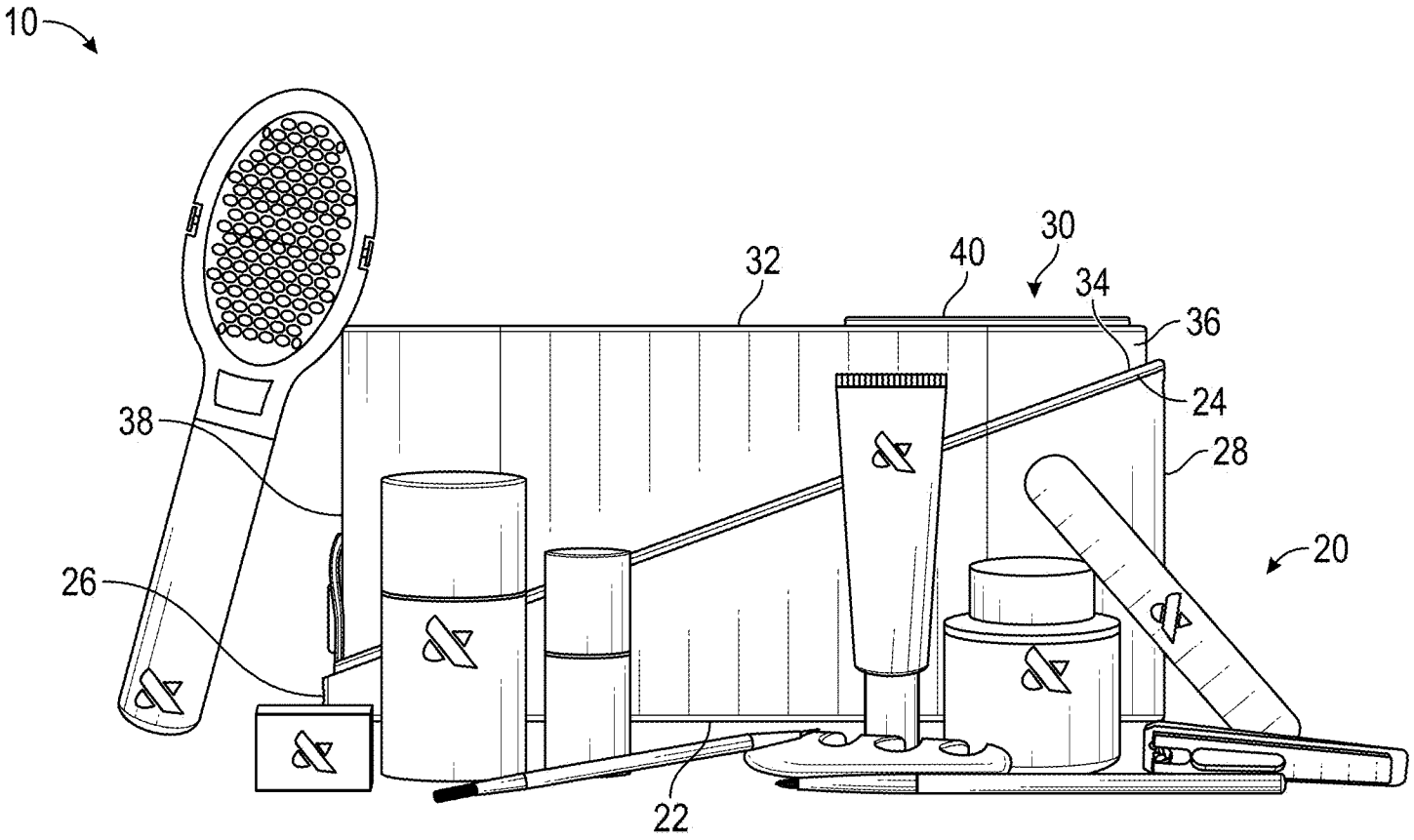
FIG. 5A is perspective view of another embodiment of a pedicure foot stand or kit in a first configuration and various components of a pedicure foot stand or kit.
Figure 5B:
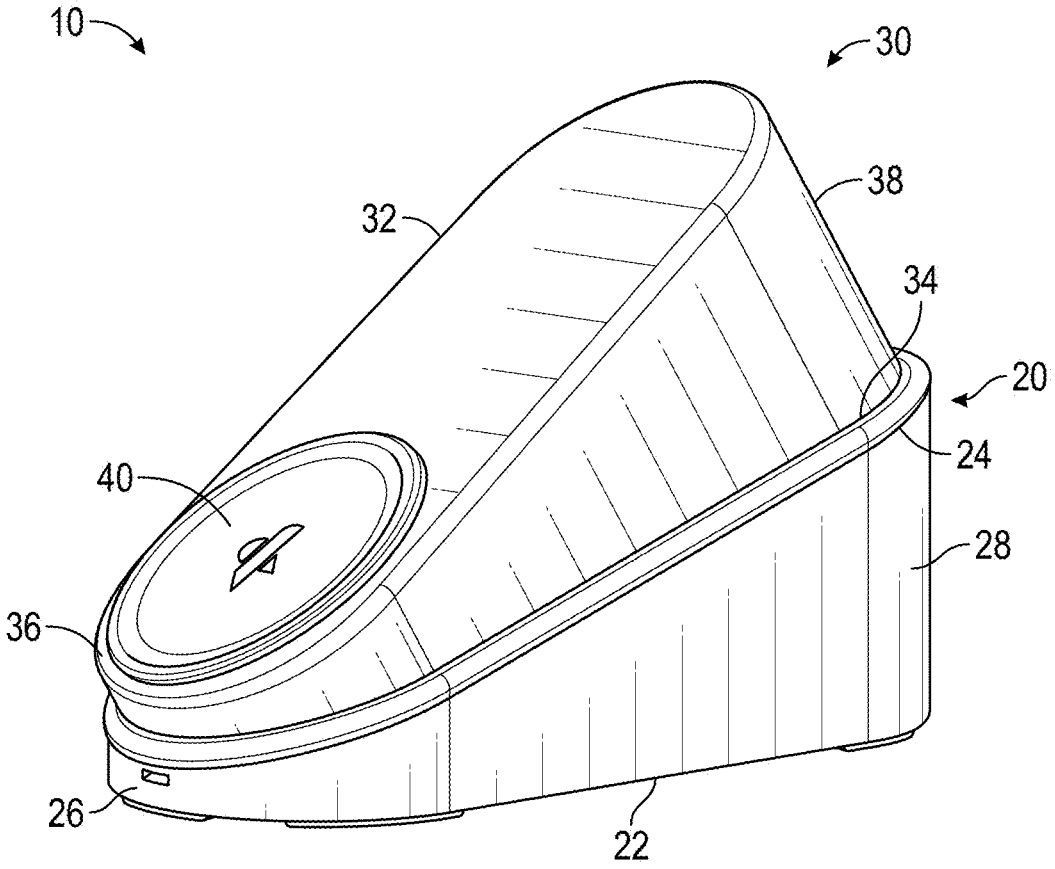
FIG. 5B is perspective view of the pedicure foot stand or kit of FIG. 5A in a second configuration.
Figure 5C:
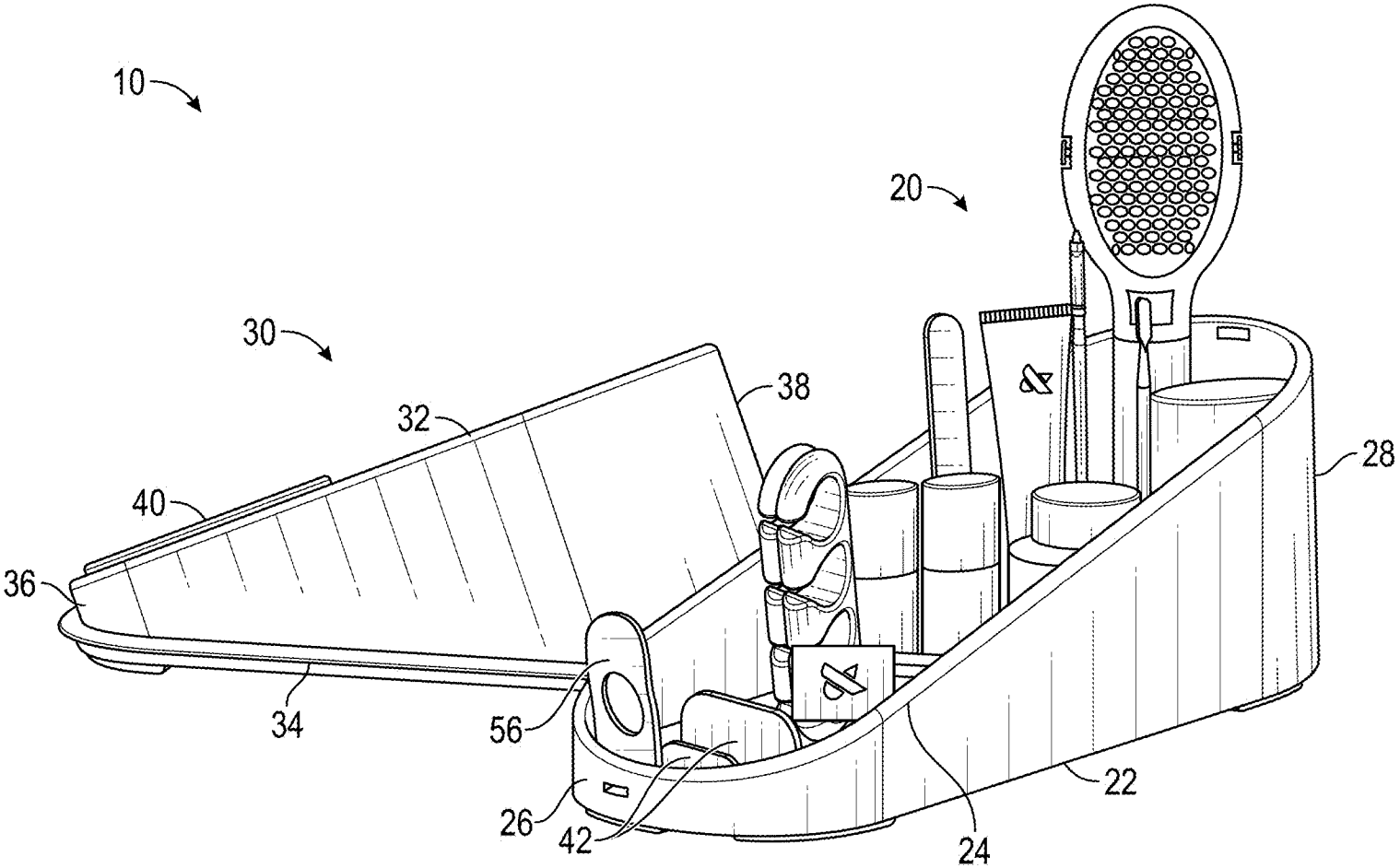
FIG. 5C is a perspective view of the pedicure foot stand or kit of FIG. 5A in a third configuration and various components of a pedicure foot stand or kit.

FIG. 5A shows another embodiment of a pedicure foot stand or kit 10 in a first configuration and various components of a pedicure foot stand or kit. FIG. 5B is shows the pedicure foot stand or kit 10 of FIG. 5A in a second configuration. FIG. 5C shows the pedicure foot stand or kit 10 of FIG. 5A in a third configuration and various components of a pedicure foot stand or kit.

The first portion 20 can define an interior cavity therein to store components, such as components of a pedicure or manicure kit, including pedicure tools and supplies. The first portion 20 can include one or more interior protrusions 42 extending from the underside of the top surface. As shown in FIG. 5C, the first portion 20 can include two interior protrusions 42 to retain the components within the interior space. The first portion 20 can include a clip 56 configured to engage a corresponding protrusion on the second portion 30 to interlock the first portion 20 and the second portion 30. As shown in FIG. 5C, the first portion 20 can have a clip 56 which extends from the short side 26. The clip 56 can additionally or alternatively retain the components within the interior space of the first portion 20.

Figure 6:
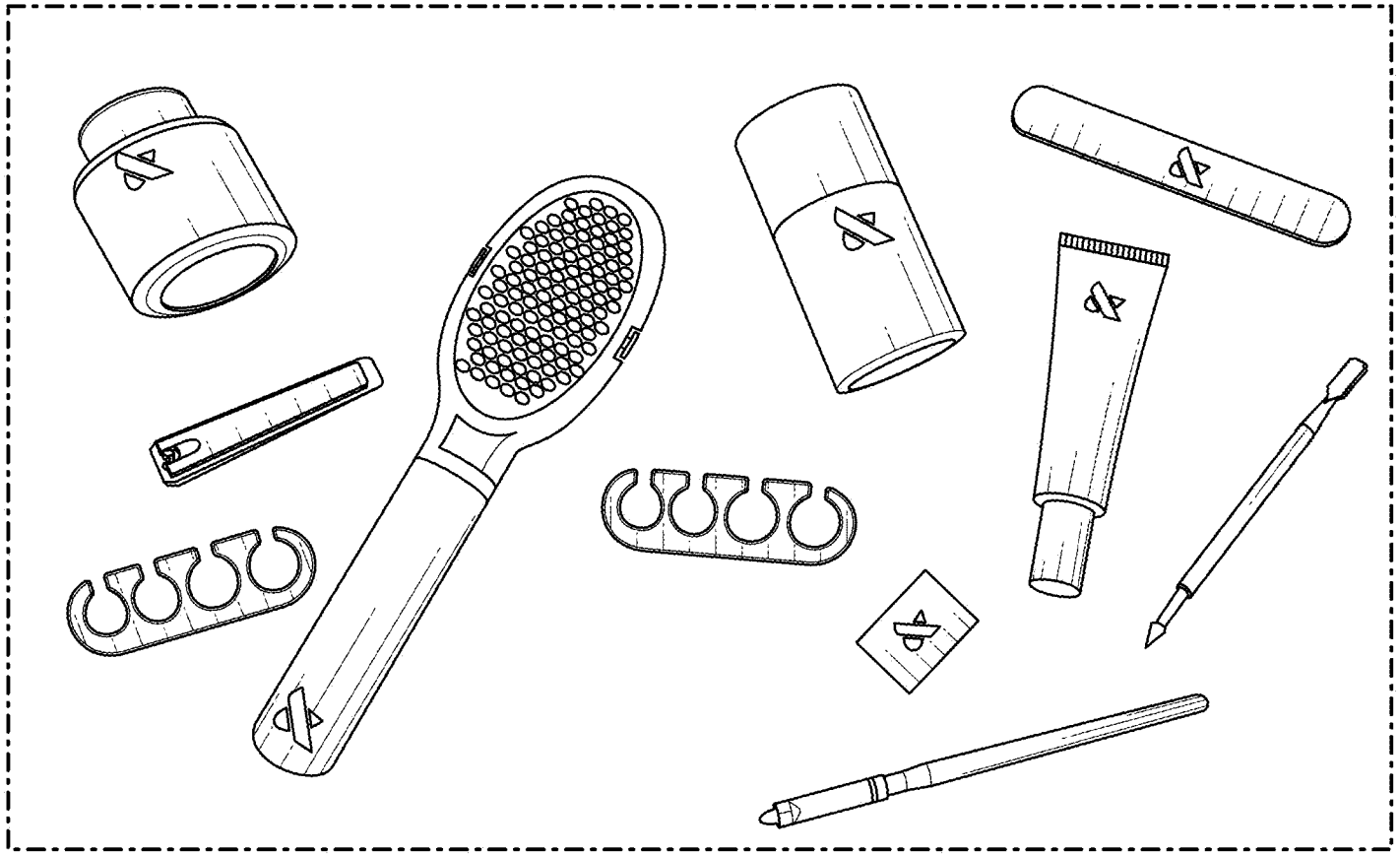
FIG. 6 is a perspective view of various components of a pedicure foot stand or kit.

FIG. 6 shows various components of a pedicure foot stand or kit 10. A variety of pedicure or manicure tools and supplies can be used. For example, as shown in FIG. 6, the components can include: nail polish remover, nail clipper, toe separators, foot file or callus remover, a nail buffer, foot serum, cuticle remover, brush, pusher, and nail file.

ADDITIONAL EMBODIMENTS

In embodiments of the present disclosure, a pedicure foot stand or pedicure kit may be in accordance with any of the following clauses:

Clause 1: A pedicure foot stand, comprising:

a housing comprising a first portion and a second portion defining an interior cavity therebetween, the first portion removably coupled to the second portion, the first portion having a first bottom end and a first top end angled relative to the first bottom end at a first angle, the first bottom end of the first portion defining a bottom surface, the second portion having a second top end and a second bottom end angled relative to the second top end at a second angle, the second top end of the second portion defining a top surface, the top surface configured to support and orient a foot of a user, wherein the second portion is configured to be coupled to the first portion in different configurations to vary an angle of the top surface of the second portion relative to the bottom surface of the first portion.

Clause 2: The pedicure foot stand of any preceding clause, wherein the top surface comprises a pad configured to receive a heel of the user's foot thereon.

Clause 3: The pedicure foot stand of any preceding clause, wherein the second bottom end of the second portion is positioned against the first top end of the first portion when the first portion and second portion are coupled together.

Clause 4: The pedicure foot stand of any preceding clause, wherein, in a first configuration, the top surface of the second portion is substantially parallel to the bottom surface of the first portion.

Clause 5: The pedicure foot stand of any preceding clause, wherein, in a second configuration, the top surface of the second portion extends at an acute angle relative to the bottom surface of the first portion.

Clause 6: The pedicure foot stand of any preceding clause, wherein an angle between the top surface of the second portion and the bottom surface of the first portion is between 30 and 60 degrees.

Clause 7: The pedicure foot stand of any preceding clause, wherein, in a third configuration, the second portion is configured to be decoupled from the bottom portion and placed on a support surface such that the top surface of the second portion is extends at an acute angle relative to the second bottom end of the second portion and relative to the support surface.

Clause 8: The pedicure foot stand of any preceding clause, wherein an angle between the top surface of the second portion and the second bottom end of the second portion is between 30 and 60 degrees.

Clause 9: The pedicure foot stand of any preceding clause, wherein the first top end of the first portion comprises an open end.

Clause 10: The pedicure foot stand of any preceding clause, wherein the second bottom end of the second portion comprises an open end.

Clause 11: The pedicure foot stand of any preceding clause, wherein the second bottom end of the second portion comprises a flange extending around a perimeter of the second portion.

Clause 12: The pedicure foot stand of any preceding clause, wherein one of the first and second portions comprises a protrusion and wherein the other of the first and second portions comprises a clip, wherein the clip is configured to engage with the protrusion to interlock the first portion and the second portion.

Clause 13: The pedicure foot stand of any preceding clause, wherein the bottom end of the first portion comprises one or more grips configured to frictionally engage a support surface the first portion is placed on.

Clause 14: The pedicure foot stand of any preceding clause, wherein the bottom angled end of the second portion comprises one or more grips configured to frictionally engage a support surface the first portion is placed on.

Clause 15: The pedicure foot stand of any preceding clause, wherein the interior cavity is configured to store a plurality of pedicure tools.

Clause 16: The pedicure foot stand of any preceding clause, wherein the pedicure tools comprises one or more of: a nail polish remover, a nail clipper, toe separators, a foot file, a nail buffer, a serum, cuticle remover, a brush, a pusher, or a nail file.

Clause 17: A pedicure kit, comprising:

a pedicure foot stand, comprising a housing having a first portion and a second portion defining an interior cavity therebetween, the first portion removably coupled to the second portion, the first portion having a first bottom end and a first top end angled relative to the first bottom end at a first angle, the first bottom end of the first portion defining a bottom surface, the second portion having a second top end and a second bottom end angled relative to the second top end at a second angle, the second top end of the second portion defining a top surface, the top surface configured to support and orient a foot of a user, the second portion configured to be coupled to the first portion in different configurations to vary an angle of the top surface of the second portion relative to the bottom surface of the first portion; and a plurality of pedicure tools stored in the interior cavity.

Clause 18: The pedicure kit of clause 17, wherein the pedicure tools comprises one or more of: a nail polish remover, a nail clipper, toe separators, a foot file, a nail buffer, a serum, cuticle remover, a brush, a pusher, or a nail file.

Clause 19: The pedicure kit of any of clauses 18 or 19, wherein the second portion can be coupled in two different configurations to the first portion to provide two different angles of the surface relative to the bottom surface.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein can be substituted for another portion in another embodiment described herein.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A pedicure foot stand, comprising:

a housing comprising a first portion and a second portion, the first portion defining a first interior cavity, the second portion defining a second interior cavity, the first portion removably coupled to the second portion, the first portion having a first bottom end and a first top end angled relative to the first bottom end at a first angle, the first bottom end of the first portion defining a bottom surface, the first top end of the first portion comprising a first continuous edge extending around a perimeter of the first portion, the second portion having a second top end and a second bottom end angled relative to the second top end at a second angle, the second bottom end of the second portion comprising a second continuous edge extending around a perimeter of the second portion, the second top end of the second portion defining a top surface, the top surface configured to support and orient a foot of a user, wherein the second portion is configured to be coupled to the first portion in different configurations to vary an angle of the top surface of the second portion relative to the bottom surface of the first portion, wherein the first portion comprises a first continuous side wall extending between the first bottom end and the first top end, wherein the second portion comprises a second continuous side wall extending between the second top end and the second bottom end, wherein, in a first configuration, an entirety of the first continuous edge of the first top end contacts an entirety of the second continuous edge of the second bottom end and the top surface of the second portion is parallel to the bottom surface of the first portion, and wherein, in a second configuration, the entirety of the first continuous edge of the first top end contacts the entirety of the second continuous edge of the second bottom end and the top surface of the second portion is at an acute angle relative to the bottom surface of the first portion.

2. The pedicure foot stand of claim 1, wherein the top surface comprises a planar surface and a pad positioned at one end of the planar surface, the pad configured to receive a heel of the user's foot thereon.

3. The pedicure foot stand of claim 1, wherein the second bottom end of the second portion is positioned against the first top end of the first portion when the first portion and the second portion are coupled together.

4. The pedicure foot stand of claim 1, wherein the acute angle between the top surface of the second portion and the bottom surface of the first portion is between 30 and 60 degrees.

5. The pedicure foot stand of claim 1, wherein, in a third configuration, the second portion is configured to be decoupled from the first portion and placed on a support surface such that the top surface of the second portion extends at an acute angle relative to the second bottom end of the second portion and relative to the support surface.

6. The pedicure foot stand of claim 5, wherein the acute angle between the top surface of the second portion and the second bottom end of the second portion is between 30 and 60 degrees.

7. The pedicure foot stand of claim 1, wherein the first top end of the first portion comprises an open end.

8. The pedicure foot stand of claim 1, wherein the second bottom end of the second portion comprises an open end.

9. The pedicure foot stand of claim 1, wherein the second bottom end of the second portion comprises a flange extending around the perimeter of the second portion.

10. The pedicure foot stand of claim 1, wherein one of the first and second portions comprises a protrusion and wherein the other of the first and second portions comprises a clip, wherein the clip is configured to engage with the protrusion to interlock the first portion and the second portion.

11. The pedicure foot stand of claim 1, wherein the first bottom end of the first portion comprises one or more grips configured to frictionally engage a support surface the first portion is placed on.

12. The pedicure foot stand of claim 1, wherein the second bottom end of the second portion comprises one or more grips configured to frictionally engage a support surface the second portion is placed on.

13. The pedicure foot stand of claim 1, wherein one or both of the first interior cavity and the second interior cavity is configured to store a plurality of pedicure tools.

14. A pedicure kit, comprising:

a pedicure foot stand, comprising a housing having a first portion and a second portion, the first portion defining a first interior cavity, the second portion defining a second interior cavity, the first portion removably coupled to the second portion, the first portion having a first bottom end and a first top end angled relative to the first bottom end at a first angle, the first bottom end of the first portion defining a bottom surface, the first top end of the first portion comprising a first continuous edge extending around a perimeter of the first portion, the second portion having a second top end and a second bottom end angled relative to the second top end at a second angle, the second bottom end of the second portion comprising a second continuous edge extending around a perimeter of the second portion, the second top end of the second portion defining a top surface, the top surface configured to support and orient a foot of a user, the second portion configured to be coupled to the first portion in different configurations to vary an angle of the top surface of the second portion relative to the bottom surface of the first portion; and a plurality of pedicure tools stored in the first and/or second interior cavity, wherein the first portion comprises a first continuous side wall extending between the first bottom end and the first top end, wherein the second portion comprises a second continuous side wall extending between the second top end and the second bottom end, wherein, in a first configuration, an entirety of the first continuous edge of the first top end contacts an entirety of the second continuous edge of the second bottom end and the top surface of the second portion is parallel to the bottom surface of the first portion, and wherein, in a second configuration, the entirety of the first continuous edge of the first top end contacts the entirety of the second continuous edge of the second bottom end and the top surface of the second portion is at an acute angle relative to the bottom surface of the first portion.

15. The pedicure kit of claim 14, wherein the pedicure tools comprises one or more of: a nail polish remover, a nail clipper, toe separators, a foot file, a nail buffer, a serum, cuticle remover, a brush, a pusher, or a nail file.

* * * * *